US006047702A

United States Patent [19]

Pennington

[11] Patent Number: 6,047,702

[45] Date of Patent: Apr. 11, 2000

[54] DISPOSABLE MANUAL FINGERNAIL FILING APPARATUS

[76] Inventor: Mary Kay Pennington, Star Rte. 51 Box 105, Glen Rose, Tex. 76043

[21] Appl. No.: 09/323,875

[22] Filed: Jun. 1, 1999

Related U.S. Application Data

[63] Continuation-in-part of application No. 29/050,563, Jan. 22, 1996, abandoned.

[51] Int. Cl.[7] ..... A45D 29/18; A45D 29/00

[52] U.S. Cl. ..... 132/76.4; 132/76.5; 132/73; 132/73.5

[58] Field of Search ..... 132/76.4, 76.5, 132/75.6, 75.3, 73.5, 73, 75.4; D28/56, 57, 59; 30/26, 27; 604/1–3

[56] References Cited

U.S. PATENT DOCUMENTS

| | | | |
|---|---|---|---|
| D. 116,216 | 8/1939 | Brekke | 132/73 |
| D. 249,167 | 8/1978 | Hovda et al. | D28/57 |
| D. 285,367 | 8/1986 | Lindner | D28/57 |
| 3,131,701 | 5/1964 | Emerson | 132/76.4 |
| 4,343,910 | 8/1982 | Busch, Jr. et al. | 132/73 |
| 4,683,898 | 8/1987 | Lojovich | 132/73 |
| 4,770,195 | 9/1988 | Dore | 132/73 |
| 5,044,383 | 9/1991 | Alessio et al. | 132/73 |
| 5,163,455 | 11/1992 | Pointe et al. | 132/73 |
| 5,275,181 | 1/1994 | Rudolph, Jr. | 132/76.4 |
| 5,439,013 | 8/1995 | Hoover | 132/73 |
| 5,588,453 | 12/1996 | Fraysher | 132/73 |
| 5,666,981 | 9/1997 | Stephens | 132/76.4 |

*Primary Examiner*—John J. Wilson
*Assistant Examiner*—Robyn K Doan
*Attorney, Agent, or Firm*—Felsman Bradley Vaden Gunter & Dillon, LLP; James E. Bradley

[57] ABSTRACT

A fingernail file has a cylindrical dowel and a filing implement on each end. The filing implements may be shaped in many different configurations including parabolic, conical or oval, but are symmetrical. Each filing implement has inner and outer layers which are bonded to the dowel. The outer layer is a thin sheet of abrasive, emery paper or fine sand paper. The inner layer is a thicker cushion or padding. The file is designed to reduce or remove the growth ridge which develops at the interface on the underside of the fingernail between the end of a natural fingernail and an artificial fingernail. The user holds the dowel and places one of the implements in contact with the subject fingernail. By manually twirling or rotating the dowel about its axis, the nail interface is gently but firmly abraded.

12 Claims, 1 Drawing Sheet

DISPOSABLE MANUAL FINGERNAIL FILING APPARATUS

This application is a Continuation-in-part of patent application Ser. No. 29/050,563, filed Jan. 22, 1996.

TECHNICAL FIELD

This invention relates in general to a fingernail files and in particular to a disposable, hand operated, abrading and polishing device for removing or blending the underside of a natural nail with an artificial nail.

BACKGROUND ART

Artificial nails are well known in the art for enhancing the appearance of natural fingernails. Artificial nails are typically applied by a manicurist by coating the top surface of the natural nail with an adhesive or similar bonding agent. The artificial nail is then placed in contact with the bonding agent until the artificial nail is secured in position. The forward edge of the artificial nail is then filed to achieve the desired appearance. Usually, the artificial nail is thereafter subjected to one or more coats of liquid polish and protectants to achieve the final appearance.

Once the artificial nail has been bonded to the natural nail, it is generally desirable that the forward edge of the natural nail be filed so that any abrupt change in thickness is eliminated, thereby diminishing the likelihood of any accumulation of unwanted material. The forward edge of the is located on the underside of the artificial nail. If the ridge or abrupt change in thickness is not removed, foreign matter including bacteria and fungus can accumulate, which can cause health problems as well as contribute to an unsightly appearance at the junction of the forward edge of the natural nail. Such a concave surface is impossible to file or burnish using a conventional emery board. This ridge on the underside also occurs with another type of artificial nail, referred to as "sculptured nails".

Some professional manicurists have employed power driven wheels to grind this junction. While such power driven wheels accomplish this task fairly quickly, the speed of the wheel used during the grinding process often generates sufficient heat through friction to cause some discomfort. Further, the abrasive wheel often contacts not only the underside of the natural nail, but also contacts the end of the finger in such a manner to abrade some surface portion of the skin at the end of the finger thus making the ends of the finger unduly sensitive.

SUMMARY OF THE INVENTION

The fingernail file of this invention has a cylindrical dowel and a filing implement on each end. The filing implements may be shaped in many different configurations including parabolic, conical or oval, but are symmetrical. Each filing implement has inner and outer layers which are bonded to the dowel. The outer layer is a thin sheet of abrasive, emery paper or fine sand paper. The inner layer is a thicker cushion or padding. The file is designed to reduce or remove the growth ridge which develops at the interface on the underside of the fingernail between the end of a natural fingernail and an artificial fingernail. The user holds the dowel and places one of the implements in contact with the subject fingernail. By manually twirling or rotating the dowel about its axis, the nail interface is gently but firmly abraded.

BEST MODE FOR CARRYING OUT THE INVENTION

Figure 1:
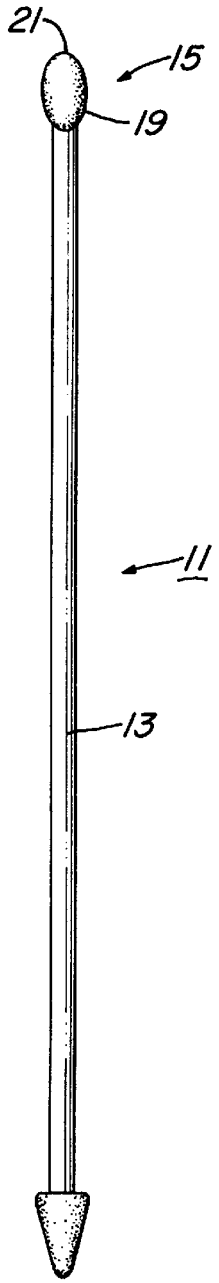
FIG. 1 is a side elevational view of a fingernail file constructed in accordance with the invention.
Figure 2:
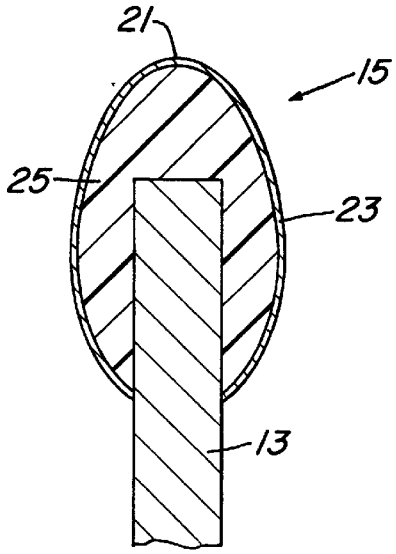
FIG. 2 is an enlarged sectional view of one end of the file of FIG. 1.

Referring to FIGS. 1 and 2, a disposable fingernail file 11 is shown. File 11 has a straight, cylindrical, wooden dowel 13. In the preferred embodiment, dowel 13 is approximately six inches long and one-eighth inch in diameter. File 11 also comprises a filing implement 15 on at least one and preferably both ends of dowel 13. Filing implement 15 is symmetrical about the axis of dowel 13. It has a general bullet-type shape, but may also be conical or parabolic. Surfaces 19 on oval filing implement 15 smoothly transition into a rounded tip 21.

As shown in FIG. 2, filing implement 15 has two layers which are fastened or bonded to one end of dowel 13. The outer layer 23 of oval filing implement 15 comprises a thin sheet of abrasive, emery paper or fine sand paper. Outer layer 23 is attached and conforms to a thicker inner layer 25 or cushion of padding. In the preferred embodiment, inner layer 25 comprises a foam-rubber material which is easily deformed but resilient. Inner layer 25 is bonded to the dowel 13.

In operation (FIG. 3), file 11 is designed to reduce or remove the growth ridge which develops at the interface on the underside of the fingernail 31 between the end of a natural fingernail and an artificial fingernail. The user holds dowel 13 near filing implement 15 with one hand and the subject fingernail 31 with the other hand. Tip 21 of oval filing implement 15 is then placed on the fingernail interface and gently but firmly twirled or rotated about the axis of dowel 13. Filing implement 15 is used to remove coarse fingernail growth at the interface.

Figure 4:
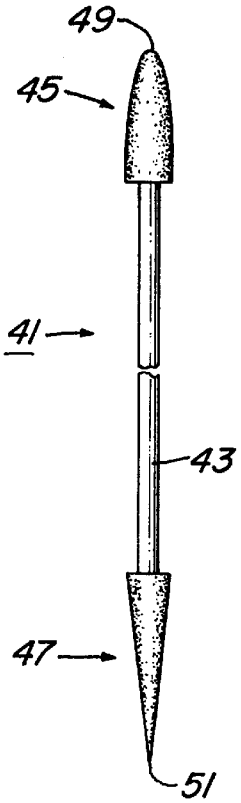
FIG. 4 is a side elevational view of a second embodiment of the file of FIG. 1.
Figure 3:
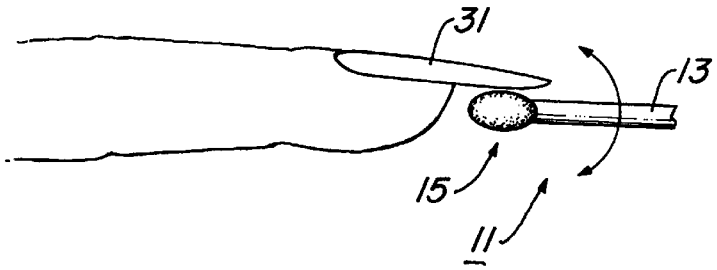
FIG. 3 is a drawing illustrating the operation of the file of FIG. 1.

Referring now to FIG. 4, a second embodiment of a disposable fingernail file 41 is shown. File 41 comprises a dowel 43 which is identical to dowel 13. File 41 has a parabolic filing implement 45 on one end and a conical filing implement 47 on an opposite end. Implements 45, 47 are completely symmetric about the axis of dowel 43. Thus, implements 45, 47 also have the same profile regardless of which side they are viewed from. Implement 45 is in the configuration of a parabola in cross-section and smoothly transitions into a rounded tip 49. Implement 47 has a conical cross-section and transitions into a point 51. The composition of implements 45, 47 is identical to those of file 11 (FIG. 3). Each implement 45, 47 has a thin outer layer of fine sand paper and a thicker inner layer of padding.

In operation, file 41 is designed for the same purposes as file 11, described above. The user holds dowel 43 near parabolic implement 45 with one hand and the subject fingernail with the other hand. Implement 45 is placed on the fingernail interface and gently but firmly twirled or rotated between the fingers of the user and about the axis of dowel 43. The symmetrical profile of implement 45 allows it to file the fingernail in a smooth rotary motion as it is twisted back and forth while in contact with the fingernail. Implement 45 is used to remove coarse fingernail growth. Conical filing implement 47 may then be used to give the fingernail interface a smooth professional finish by twirling or rotating it in the same manner.

The invention has advantages. The invention provides a disposable, hand operated rather than power operated manicuring device that abrades a natural fingernail under an artificial nail while avoiding any discomfort to the person receiving the manicure. The unique shapes and profiles of the implements on these files allow the user greater precision, control and sensitivity for filing fingernails than would otherwise be available with conventional emery boards. In particular, the smooth, symmetrical profiles of the implements allow them to be spun in place at the point of contact.

While the invention has been shown or described in only some of its forms, it should be apparent to those skilled in the art that it is not so limited, but is susceptible to various changes without departing from the scope of the invention.

I claim:

1. A disposable fingernail file, comprising:

an elongated, substantially cylindrical dowel having a dowel axis, a first end, and a second end; and a filing implement coaxially mounted to the first end of the dowel and having an implement axis that coincides with the dowel axis, a profile that is completely symmetrical about the implement axis and the dowel axis, an abrasive outer surface, and a padded inner layer; and wherein when the filing implement in placed in contact with an underside of a subject fingernail and the dowel is manually rotated back and forth about the dowel axis between the fingers of a practitioner, the abrasive outer layer maintains a consistent rotational profile so that it stays in smooth, continuous filing contact with the underside of the fingernail.

2. The fingernail file of claim 1 wherein the filing implement has a parabolic shape in cross-section.

3. The fingernail file of claim 1 wherein the filing implement has a conical shape in cross-section.

4. The fingernail file of claim 1 wherein the filing implement has a oval shape in cross-section.

5. The fingernail file of claim 1 wherein the outer layer comprises emery paper.

6. The fingernail file of claim 1 wherein the inner layer comprises a foam material.

7. The fingernail file of claim 1 wherein the outer layer is bonded to the inner layer and the inner layer is bonded to the dowel.

8. The file of claim 1, further comprising a second file implement coaxially mounted on the second end of the dowel and having a second implement axis that coincides with the dowel axis and a smooth, completely symmetrical profile about the second implement axis and the dowel axis, the second file implement maintaining a consistent rotational profile that stays in smooth, continuous filing contact with the underside of the fingernail.

9. A disposable fingernail file, comprising:

an elongated, substantially cylindrical dowel having a dowel axis, a first end, and a second end;

first and second filing implements coaxially mounted to the first and second ends of the dowel, respectively, each of the implements having an implement axis that coincides with the dowel axis, a conical profile that is completely symmetrical about the implement and dowel axes, a padded inner layer that is bonded to the dowel, and an abrasive outer surface that is bonded to its respective inner layer; and wherein when a selected one of the filing implements is placed in contact with an underside of a subject fingernail and the dowel is manually rotated back and forth about the dowel axis between the fingers of a practitioner, the abrasive outer layer of said selected one of the filing implements maintains a consistent rotational profile so that it stays in smooth, continuous filing contact with the underside of the fingernail.

10. The fingernail file of claim 9 wherein each of the outer layers of the filing implements comprises emery paper.

11. The fingernail file of claim 9 wherein each of the inner layers of the filing implements comprises a foam material.

12. A method for filing an underside of a fingernail, comprising:

(a) providing a disposable fingernail file having a cylindrical dowel with a dowel axis, an end, and a filing implement mounted to the end and having an implement axis that coincides with the dowel axis such that the filing implement has a completely axially symmetric profile;

(b) placing the filing implement in contact with an underside portion of a subject fingernail; and then (c) manually rotating the dowel back and forth about the axis such that the filing implement maintains a consistent rotational profile and stays in smooth, continuous filing contact with the underside of the fingernail.

* * * * *